US005860649A

United States Patent [19]

Buchholz

[11] Patent Number: 5,860,649

[45] Date of Patent: Jan. 19, 1999

[54] COIN-OPERATED, TIME-CONTROLLED TABLE GAME APPARATUS

[75] Inventor: Andreas Buchholz, Muenster-Sarmsheim, Germany

[73] Assignee: NSM Aktiengesellschaft, Bingen, Germany

[21] Appl. No.: 793,139

[22] PCT Filed: Aug. 16, 1995

[86] PCT No.: PCT/DE95/01109

§ 371 Date: Feb. 19, 1997

§ 102(e) Date: Feb. 19, 1997

[87] PCT Pub. No.: WO96/06416

PCT Pub. Date: Feb. 29, 1996

[30] Foreign Application Priority Data

Aug. 20, 1994 [DE] Germany ..... 44 29 621.5

[51] Int. Cl.[6] ..... A63F 7/07

[52] U.S. Cl. ..... 273/108.54; 273/119 R

[58] Field of Search ..... 273/108.5, 108.51, 273/108.52, 108.53, 108.54, 108.55, 108.56, 108.57, 119 R, 129 S, 129 T, 129 U, 129 V, 129 W

[56] References Cited

U.S. PATENT DOCUMENTS

| | | | |
|---|---|---|---|
| 660,798 | 10/1900 | Matthewson | 273/108.55 |
| 1,812,932 | 7/1931 | Chester | 273/108.54 |
| 2,668,057 | 2/1954 | Fry | 273/108.54 |
| 3,400,930 | 9/1968 | Leonhart | 273/108.52 |
| 4,480,833 | 11/1984 | Barcelow | 273/108.56 |
| 5,046,734 | 9/1991 | Laine | 273/108.56 |

FOREIGN PATENT DOCUMENTS

| | | |
|---|---|---|
| 746550 | 5/1933 | France . |
| 2657834 | 6/1978 | Germany . |

*Primary Examiner*—Sebastiano Passaniti
*Attorney, Agent, or Firm*—Venable; George H. Spencer; Ashley J. Wells

[57] ABSTRACT

A coin-operated, time-controlled table game apparatus includes a plurality of movable rods which support respective playing pieces; and a locking device including at least one locking beam which can be moved up and down, and which supports at least one pin, wherein at least one of the plurality of movable rods, after the expiration of playing time, is fixed in place by the locking device, wherein each rod to be fixed in place has defined therein at least one groove extending in the axial direction into which an associated pin of the locking device is inserted after the expiration of playing time, and wherein a pin is provided for each rod to be fixed in place, the pin projecting relative to the longitudinal axis of the locking beam and being positioned in alignment with an associated rod such that it plunges into the groove of the associated rod when the locking beam is engaged after the expiration of playing time. Alternatively, a coin-operated, time-controlled table game apparatus includes a plurality of movable rods which support respective playing pieces; and a braking device comprised of a locking beam which can be moved up and down, wherein, after the expiration of the playing time, at least one of the plurality of movable rods is rendered stiff by the braking device, and wherein the locking beam has at least one braking element associated with each rod which is to be rendered stiff such that the at least one braking element renders stiff the associated rod when the locking beam is engaged after the expiration of the playing time.

13 Claims, 1 Drawing Sheet

COIN-OPERATED, TIME-CONTROLLED TABLE GAME APPARATUS

BACKGROUND OF THE INVENTION

1. Field of the Invention

The invention relates to a coin-operated, time-controlled table soccer apparatus, table hockey apparatus or similar table game apparatus having movable rods which support playing pieces, of which rods, after the expiration of the playing time, at least one can be fixed in place by a locking device, with the rod to be fixed in place having at least one groove into which a pin of the locking device can be inserted.

2. Description of the Related Art

With table game apparatuses, in particular, coin-operated apparatuses, either a specific number of balls are provided for a game or a game sequence or the game can be played for a specific time duration and, after its expiration, the game can be continued with the ball which is on the playing field at that time until this ball disappears in a goal.

In order to be able to play without paying money, the players have devised different manipulation measures. Thus, it occurs again and again that foreign objects, hats, scarfs, sponges, etc. are stuffed into the goal area. This means that the ball cannot get lost by scoring a goal, i.e., a hit, and the game can be played with a ball for any desired amount of time. Instead of using a foreign object, some players have started to cover the goal area or the opening of the goal with metal plates or wooden plates which are true to size.

One alternative for these manipulation measures might be for the players to bring their own balls. But this would entail the drawback that, in the event of a goal, the balls would be lost. Then, the only question would be what is more expensive, the ball or purchasing additional playing time.

The operators of such table game apparatuses suffer sometimes considerable losses in sales as a result of such manipulations, which has already led to the consideration of countermeasures. Thus, from DE-A-26 57 834, an arrangement for ensuring a proper game operation on a coin-operated table soccer apparatus is known which operates with a plugging barrier in the form of a finger associated with the goal area, which finger is connected with the playing rod supporting the goalkeeper and which can be moved back and forth. The finger is connected via a telescope arrangement to a catch which is fastened to the playing rod.

Furthermore, time-controlled, coin-operated table game apparatuses are known which limit the playing time through combinations of a defined number of playing balls, the switching off of the point counting devices and/or the blocking of the goals. However, these measures also do not represent an effective protection against the above-mentioned manipulation measures since these can be circumvented by simple means such as playing with player-owned balls or a different manner of counting points.

From FR-A-746 550, a table game apparatus is known wherein, after the expiration of the playing time, at least one of the rods is fixed in place by a locking device. The rod to be fixed in place is provided with at least one groove into which a leg of the lever of the locking device is inserted so that the respective rod remains in its momentary position of fixation.

It is the object of the invention to improve certain game characteristics at the end of the playing time and to ensure in this process that the playing time is limited effectively for a coin-operated, time-controlled table soccer apparatus, table hockey apparatus or similar table game apparatus of the type mentioned at the outset without necessitating a connection to the mains supply.

SUMMARY OF THE INVENTION

This object is solved according to the invention in that the at least one groove extends in the axial direction, and the locking device is provided with at least one locking beam which can be moved up and down and which supports a pin for each rod to be fixed in place, with the pin projecting relative to the longitudinal axis of the locking beam and which can be fixed in its position in alignment with the associated rod such that it plunges into the groove of the rod when the locking beam is operated.

An alternative solution of the object is characterized according to the invention in that, after the expiration of the playing time, at least one of the rods is rendered stiff by means of a braking device, with the braking device comprising a locking beam which can be moved up and down having at least one braking element associated with a rod which is to be rendered stiff.

These alternative measures force the game to end after the expiration of the playing time in that at least one of the rods can no longer be moved or be moved only with difficulty, which makes it impossible to continue the game in a meaningful way. It is particularly advantageous to lock or render stiff the rod which supports the goalkeeper, while it is possible, of course, to hinder still further rods in their freedom of movement. Only a further purchase of playing time releases the locking device or the braking device and thus eliminates the fixing in place or the stiffness of the rod.

Furthermore, preferably the rod to be fixed in place can be provided with several grooves arranged in any desired graduation. This offers the greatest probability that, after the expiration of the playing time, the rod quickly assumes a position in which the pin of the locking device can plunge into one of the grooves of the rod and the table game apparatus is thus rendered inoperable.

According to an advantageous embodiment of the invention, the locking beam is guided in the longitudinal as well as in the transverse direction in a side wall of the housing of the table game apparatus, which side wall supports the rods. This results in the locking beam and thus the pin being positioned accurately relative to the rod which is to be fixed in place. Advisably, the pin attached to the locking beam is chamfered at its projecting front face. This facilitates the plunging of the pin into the groove of the rod.

For a fixing in place of several rods by the locking beam, the projecting pins are preferably seated so as to be resilient in their longitudinal direction. In this manner, the seating tolerances of the rods in the side wall of the table game apparatus as well as the positional and dimensional tolerances of the locking beam and of the pins are compensated for. Furthermore, the pins are prevented from jamming.

In a further embodiment of the invention, the locking beam is held by spring force in its upper stop position for fixing the rods in place. In this process, the spring force acting on the locking beam is preferably applied by two pressure springs. Since the pressure springs serve as mechanical energy stores, an electrical user is not required for the blocking effect of the locking beam, which avoids a greater power consumption of the table game apparatus.

Advisably, the locking beam can be transferred counter to the spring force for the release of the locked rods into its lower stop position by an operating lever which is manipulated manually, with the operating lever only being released by an actuatable locking device when a sufficient stake has been offered. The locking device may be realized by an electromagnetically controlled fixing element which requires only a short current pulse for both the release and for the locking of the operating lever, which current pulse is emitted accordingly by the coin processing device. Preferably, the operating lever is provided with a catch which transfers the movement of the operating lever to the locking beam. This catch is configured and arranged such that the circular arc-shaped movement of the operating lever can be translated into a straight-line movement which engages the center of the locking beam. Advisably, fixed stops are associated with the operating lever for limiting the path. Furthermore, by means of a restoring spring, the operating lever is preferably returned to its initial position in which it is held by the associated locking device.

In a further embodiment of the invention, the locking beam is fixed in place in its lower stop position, in which the pressure springs are under tension, by at least one actuatable fixing element. The actuation of the fixing element can occur electromagnetically by means of a timer.

BRIEF DESCRIPTION OF THE DRAWINGS

The concept on which the invention is based is explained in greater detail in the description below by way of an embodiment which is illustrated in the drawing. It shows.

DESCRIPTION OF THE PREFERRED EMBODIMENTS

Figure 2:
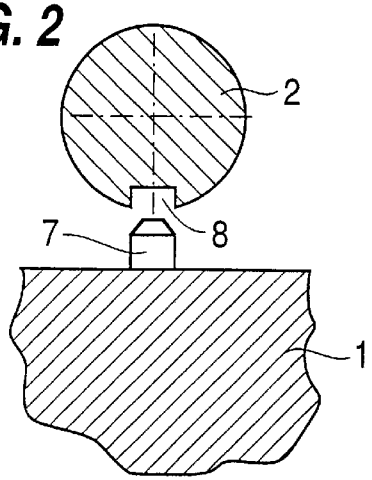
Figure 3:
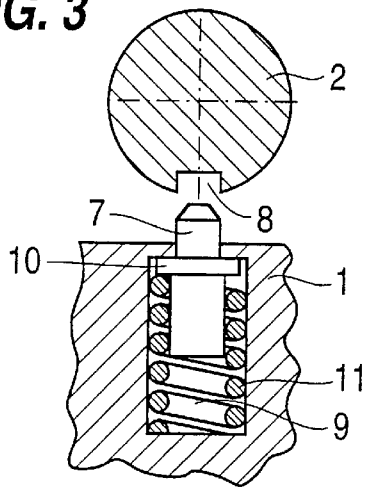

The coin-operated, time-controlled table game apparatus has a housing 6 in whose side walls are seated movable rods 2 which support playing pieces. A locking device 20 for the rods 2 is accommodated in one of the side walls of the housing 6. The locking device 20 comprises a locking beam 1 which is substantially rectangular-shaped and arranged horizontally and which can be moved up and down. The locking beam 1 is guided in its longitudinal as well as its transverse direction in the side wall of the housing 6. On the side of the locking beam 1 facing away from the rods 2, there are two sinks 3 disposed opposite of one another which are respectively engaged by the free end of a pressure spring 4. The other free end of the pressure springs 4 is supported against associated cylindrical sinks 3 of a thrust bearing 5 arranged at a distance to the locking beam 1. On the side of the locking beam facing the rods 2, a pin 7 is respectively arranged in the longitudinal axis of the rods 2. When the locking beam 1 moves upward, the pins 7 can plunge into an associated groove 8 of the respective rod 2. If only one rod 2 is blocked, the pin 7 is fixedly connected to the locking beam 1 (FIG. 2). If it is desired to fix several rods 2 in place, a corresponding number of T-slots 9 is cut into the locking beam 1. The T-slots 9 are disposed transversely to the longitudinal axis of the locking beam 1 and receive the pins 7 loaded with pressure springs 11. Here, the pins 7 have an enlarged annular-shaped attachment 10 which determines the height of the projection of the pin 7 from the locking beam 1. Below the annular-shaped attachment 10, the outside diameter of the pin 7 is dimensioned such that it can be inserted into the inside diameter of the pressure spring 11. In each case, the pin is chamfered at its projecting front face, which helps it to plunge into the groove 8 of the rod 2. The spring-loaded arrangement of the pins 7 allows the plunging of a bolt 7 into the groove of the rod 2 associated with it in case of a correspondingly superposed position, namely, independently of the positions of the other rods 2.

Figure 1:
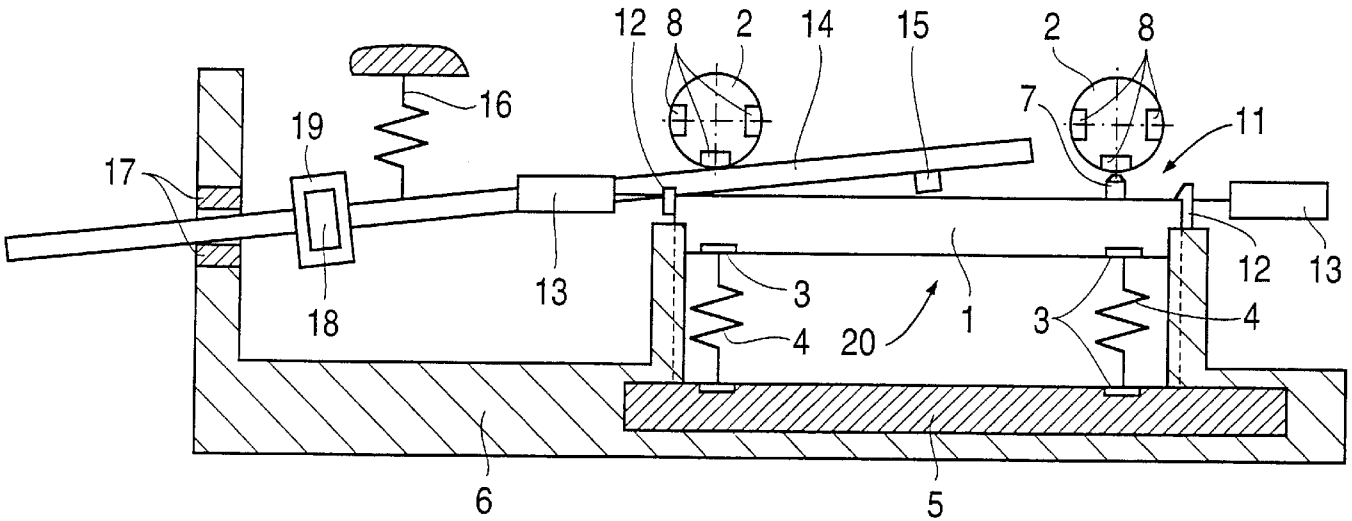
FIG. 1 a simplified section through the side wall of the housing of a table game apparatus according to the invention, FIG. 2 an enlarged illustration of the detail II of FIG. 1, and FIG. 3 an alternative embodiment of the illustration according to FIG. 2.

The illustration in FIG. 1 shows the locking beam 1 in its lower stop position in which the rods 2 are not fixed in place. In this position, the pressure springs 4 are under tension and the locking beam 1 is fixed in place by fixing elements 12 which are operated by time-controlled electromagnets 13 which are connected to a battery or an accumulator. After the expiration of the playing time, an electrical pulse is given to the electromagnets 13 which then withdraw the fixing elements 12 from their functional position, which causes the locking beam 1 with the pins 7 to move into its upper stop position in the direction of the rods 2 because of the force exerted by the pressure springs 4. If one of the rods 2 which is to be fixed in place is put into a position in which groove 8 and pin 7 are standing on top of one another, the pin 7 plunges into the groove 8 and thus the rod 2 is fixed in place by means of form-lockup between pin 7 and rod 8.

An operating lever 14 which is rotatably seated and extending outwardly through the housing 6 is fixed in place in its upper initial position by means of a fixing element 18 with associated electromagnet 19. A catch 15 mounted on the operating lever 14 contacts the locking beam 1 in its upper stop position. After the purchase of playing time, the release of the operating lever 14 occurs in that the fixing element 18 is withdrawn from its functional position by means of the electromagnet 19 which has received a corresponding pulse from the coin processing arrangement installed in the table game apparatus. After its release, the operating lever 14 is moved manually counter to the force of a restoring spring 16 into its lower stop position. The catch 15, which is fastened on the operating lever 14, transfers this movement to the locking beam 1 as a result of which the latter is pressed into its lower stop position counter to the force of the pressure springs 4 and is held in place by the fixing elements 12. Thus, the rods 2 are freely movable. The operating lever 14 is moved back into its upper initial position by the restoring spring 16 and is locked by the fixing element 18. Otherwise, the movement of the operating lever 14 is limited by stops 17 which are fixedly mounted on the housing.

What is claimed is:

1. A coin-operated, time-controlled table game apparatus, comprising:

a plurality of movable rods which support respective playing pieces; and a locking device comprising at least one locking beam which can be moved up and down, and which supports at least one pin, wherein at least one of the plurality of movable rods, after the expiration of playing time, is fixed in place by the locking device, wherein each rod to be fixed in place has defined therein at least one groove extending in the axial direction into which an associated pin of the locking device is inserted after the expiration of playing time, and wherein a pin is provided for each rod to be fixed in place, the pin projecting relative to the longitudinal axis of the locking beam and being positioned in alignment with an associated rod such that it plunges into the groove of the associated rod when the locking beam is engaged after the expiration of playing time.

2. A coin-operated, time-controlled table game apparatus, comprising:

a plurality of movable rods which support respective playing pieces; and a braking device comprised of a locking beam which can be moved up and down, wherein, after the expiration of the playing time, at least one of the plurality of movable rods is rendered stiff by the braking device, and wherein the locking beam has at least one braking element associated with each rod which is to be rendered stiff such that the at least one braking element renders stiff the associated rod when the locking beam is engaged after the expiration of the playing time.

3. The table game apparatus according to claim 1, wherein each rod to be fixed in place has defined therein a plurality of grooves arranged in any preselected graduation.

4. The table game apparatus according to claim 1, further comprising a housing in which the rods are seated, and wherein the locking beam is guided in the longitudinal direction and in the transverse direction within a side wall of the housing.

5. The table game apparatus according to claim 1, wherein the at least one pin supported on the locking beam is chamfered at its projecting front face.

6. The table game apparatus according to claim 1, wherein a plurality of rods are fixed in place by the locking beam, and wherein the pins projecting relative to the longitudinal axis are seated so as to be resilient in their longitudinal direction.

7. The table game apparatus according to claim 1, wherein the locking beam has an upper stop position which is engaged after the expiration of playing time, and wherein the locking beam is held by spring force in the upper stop position.

8. The table game apparatus according to claim 7, wherein the spring force acting on the locking beam is applied by two pressure springs.

9. The table game apparatus according to claim 7, further comprising an operating lever and an actuatable locking device which holds the operating lever in an initial position so that at least one rod is locked and which releases the operating lever so that locked rods are released when actuated by insertion of sufficient coinage into the table game apparatus, wherein the locking beam has a lower stop position in which the at least one pin supported thereon does not engage the respective associated rod, and wherein the locking beam is moved counter to the spring force into the lower stop position by manual manipulation of the operating lever after release thereof.

10. The table game apparatus according to claim 9, wherein the operating lever is provided with a catch which transfers the movement of the operating lever to the locking beam.

11. The table game apparatus according to claim 9, further comprising a housing and stops which are fixedly mounted on the housing and which are associated with the operating lever so that the operating lever has a path which is limited.

12. The table game apparatus according to claim 9, further comprising a restoring spring for returning the operating lever to the initial position in which the operating lever is held by the actuatable locking device so that at least one rod is locked.

13. The table game apparatus according to claim 9, wherein the spring force acting on the locking beam is applied by two pressure springs, and wherein the table game apparatus further comprises at least one actuatable fixing element for fixing the locking beam in place in the lower stop position in which the two pressure springs are under tension.

* * * * *